US011224785B2

(12) United States Patent
Akiyama

(10) Patent No.: US 11,224,785 B2
(45) **Date of Patent: *Jan. 18, 2022**

(54) GOLF CLUB HEAD OR OTHER BALL STRIKING DEVICE HAVING IMPACT-INFLUENCING BODY FEATURES

(71) Applicant: KARSTEN MANUFACTURING CORPORATION, Phoenix, AZ (US)

(72) Inventor: Hiromitsu Akiyama, Tokyo (JP)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/875,746

(22) Filed: May 15, 2020

(65) Prior Publication Data

US 2020/0276483 A1 Sep. 3, 2020

Related U.S. Application Data

(63) Continuation of application No. 15/892,179, filed on Feb. 8, 2018, now Pat. No. 10,682,554, which is a continuation of application No. 14/725,841, filed on May 29, 2015, now Pat. No. 9,925,428.

(51) Int. Cl.
*A63B 53/04* (2015.01)

(52) U.S. Cl.
CPC ..... *A63B 53/0466* (2013.01); *A63B 53/04* (2013.01); *A63B 53/0408* (2020.08); *A63B 53/0425* (2020.08); *A63B 53/0437* (2020.08); *A63B 2209/00* (2013.01)

(58) Field of Classification Search
CPC ..... A63B 53/0466; A63B 53/04; A63B 2053/0408; A63B 2053/0425; A63B 2053/0437; A63B 2209/00
See application file for complete search history.

(56) References Cited

U.S. PATENT DOCUMENTS

| | | | | |
|---|---|---|---|---|
| 1,946,208 | A | 2/1934 | Hampton | |
| 4,313,607 | A | 2/1982 | Thompson | |
| 5,547,427 | A | 8/1996 | Rigal et al. | |
| 5,570,886 | A | 11/1996 | Rigal et al. | |
| 5,624,331 | A * | 4/1997 | Lo | A63B 53/0466 473/345 |

(Continued)

FOREIGN PATENT DOCUMENTS

| | | |
|---|---|---|
| JP | H09000666 | 1/1997 |
| JP | 2002052099 A | 2/2002 |
| JP | 2004089567 A | 3/2004 |

OTHER PUBLICATIONS

Jul. 12, 2016—(WO) ISR & WO—App. No. PCT/US2015/032821.

(Continued)

*Primary Examiner* — Steven B Wong

(57) ABSTRACT

A ball striking device, such as a golf club head, has a face member with a striking surface configured for striking a ball and a flange that comprises a portion of the crown. The flange being made of at least two members that are made of different materials, where a second material has a lower modulus of elasticity than the first material. The second member has a length, a width, a thickness and a location proximate to the ball striking surface to improve the impact efficiency of a collision with a golf ball.

20 Claims, 16 Drawing Sheets

(56) References Cited

U.S. PATENT DOCUMENTS 5,669,827 A 9/1997 Nagamoto
5,674,132 A 10/1997 Fisher
5,803,830 A 9/1998 Austin et al.
5,908,357 A 6/1999 Hsieh
6,334,817 B1 1/2002 Ezawa
6,435,982 B1 8/2002 Galloway et al.
6,443,857 B1 9/2002 Chuang
6,390,933 B1 11/2002 Galloway et al.
6,607,452 B2 8/2003 Helmstetter
6,739,983 B2 5/2004 Helmstetter et al.
6,783,466 B2 * 8/2004 Seki ..... A63B 60/00 473/345
D498,508 S 11/2004 Antonious et al.
6,899,638 B2 5/2005 Iwata et al.
6,949,031 B2 9/2005 Imamoto
6,969,326 B2 * 11/2005 De Shiell ..... A63B 53/0466 473/345
6,994,636 B2 2/2006 Hocknell
7,025,692 B2 4/2006 Erickson et al.
7,066,835 B2 6/2006 Evans et al.
7,175,541 B2 2/2007 Lo
7,207,898 B2 4/2007 Rice et al.
7,252,599 B2 * 8/2007 Hasegawa ..... A63B 53/0466 473/329
7,261,643 B2 8/2007 Rice et al.
7,303,487 B2 * 12/2007 Kumamoto ..... A63B 53/0466 473/345
7,361,100 B1 4/2008 Morales
7,435,190 B2 10/2008 Sugimoto
7,476,161 B2 1/2009 Williams et al.
7,575,524 B2 8/2009 Willett et al.
7,699,719 B2 * 4/2010 Sugimoto ..... A63B 53/0466 473/345
7,803,065 B2 9/2010 Breier et al.
7,887,436 B2 2/2011 Hirano
7,931,545 B2 4/2011 Soracco et al.
8,007,371 B2 8/2011 Breier et al.
8,133,135 B2 3/2012 Stites et al.
8,187,116 B2 5/2012 Boyd et al.
8,342,984 B2 * 1/2013 Boyd ..... A63B 53/04 473/345
8,376,879 B2 * 2/2013 Wada ..... A63B 53/0466 473/342
8,435,134 B2 5/2013 Tang et al.
8,491,416 B1 7/2013 Demille et al.
8,517,860 B2 8/2013 Albertsen et al.
8,591,351 B2 11/2013 Albertsen et al.
8,632,419 B2 * 1/2014 Tang ..... A63B 60/52 473/329
8,821,312 B2 9/2014 Burnett et al.
8,827,831 B2 9/2014 Burnett et al.
8,834,290 B2 9/2014 Bezilla et al.
8,938,871 B2 * 1/2015 Roach ..... A63B 60/02 29/401.1
8,956,242 B2 * 2/2015 Rice ..... A63B 53/0466 473/329
8,961,332 B2 * 2/2015 Galvan ..... A63B 53/04 473/329
8,986,133 B2 3/2015 Bennett et al.
9,011,267 B2 4/2015 Burnett et al.
9,089,747 B2 7/2015 Boyd et al.
9,089,749 B2 7/2015 Burnett et al.
9,526,956 B2 12/2016 Murphy et al.
9,925,428 B2 * 3/2018 Akiyama ..... A63B 53/04
10,682,554 B2 * 6/2020 Akiyama ..... A63B 53/04
2002/0094883 A1 7/2002 Chuang
2003/0125127 A1 * 7/2003 Nakahara ..... A63B 60/00 473/329
2004/0192467 A1 * 9/2004 Hocknell ..... A63B 60/00 473/345
2005/0119068 A1 6/2005 Onoda et al.
2005/0215350 A1 * 9/2005 Reyes ..... A63B 53/0466 473/344
2005/0266933 A1 12/2005 Galloway
2006/0019770 A1 1/2006 Meyer et al.
2006/0030424 A1 * 2/2006 Su ..... A63B 53/0466 473/342
2006/0068932 A1 3/2006 Rice et al.
2006/0073910 A1 4/2006 Imamoto et al.
2006/0189410 A1 8/2006 Soracco
2006/0199665 A1 9/2006 Lo
2007/0049407 A1 3/2007 Tateno et al.
2007/0049417 A1 3/2007 Shear
2007/0155538 A1 7/2007 Rice et al.
2007/0219018 A1 9/2007 Hirano
2008/0015047 A1 1/2008 Rice et al.
2008/0125244 A1 5/2008 Meyer et al.
2008/0182682 A1 7/2008 Rice et al.
2009/0098949 A1 4/2009 Chen
2009/0318245 A1 12/2009 Yim et al.
2010/0056298 A1 3/2010 Jertson
2011/0111885 A1 5/2011 Golden
2011/0218053 A1 9/2011 Tang et al.
2011/0256954 A1 10/2011 Soracco
2011/0294599 A1 12/2011 Albertsen et al.
2012/0083362 A1 4/2012 Albertsen et al.
2012/0083363 A1 4/2012 Albertsen et al.
2012/0135821 A1 * 5/2012 Boyd ..... A63B 60/00 473/342
2012/0142452 A1 6/2012 Burnett et al.
2013/0065705 A1 3/2013 Morales et al.
2014/0080624 A1 3/2014 Galvan
2014/0080634 A1 3/2014 Golden
2014/0323237 A1 10/2014 Beno
2015/0094164 A1 4/2015 Galvan et al.
2016/0051868 A1 2/2016 Deshmukh
2016/0067560 A1 3/2016 Golden et al.
2016/0067563 A1 3/2016 Murphy et al.
2016/0346646 A1 * 12/2016 Bennett ..... A63B 60/54
2017/0028284 A1 * 2/2017 Galvan ..... A63B 53/06

OTHER PUBLICATIONS

Callaway 2015 XR Driver, http://www.callawaygolfpreowned.com/golf-clubs/drivers/drivers-2015-xr.html, visited on Jun. 4, 2018.
Nov. 18, 2016—(WO) ISR & WO—App. No. PCT/US2016/050897.

* cited by examiner

GOLF CLUB HEAD OR OTHER BALL STRIKING DEVICE HAVING IMPACT-INFLUENCING BODY FEATURES

CROSS REFERENCES

This is a continuation of U.S. patent application Ser. No. 15/892,179, filed on Feb. 8, 2018, which is a continuation of U.S. patent application Ser. No. 14/725,841, filed on May 29, 2015, and now U.S. Pat. No. 9,925,428 which is incorporated herein in its entirety by reference.

TECHNICAL FIELD

The invention relates generally to golf club heads and other ball striking devices that include impact influencing body features. Certain aspects of this invention relate to golf club heads and other ball striking devices that have more a face member that contains a ball striking surface and a portion of the crown where a flexible material is integrated with the crown portion of the face member.

BACKGROUND

Golf clubs and many other ball striking devices may have various face and body features, as well as other characteristics that can influence the use and performance of the device. For example, users may wish to have improved impact properties, such as increased coefficient of restitution (COR) in the face, increased size of the area of greatest response or COR (also known as the "hot zone") of the face, and/or improved efficiency of the golf ball on impact. The COR is defined as a ratio of the relative speed of the ball after impact divided by the relative speed of the ball before the impact. Since a significant portion of the energy loss during an impact of a golf club head with a golf ball is a result of energy loss as the golf ball deforms, reducing deformation of the golf ball during impact may increase energy transfer and velocity of the golf ball after impact, which benefits the golfer in the form of greater distance. The present devices and methods are provided to address at least some of these problems and other problems, and to provide advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the disclosure relate to a ball striking device, such as a golf club head, having a club head body made of a first material comprising a heel, a toe, a portion of a crown, a sole, and a portion of a striking surface and a face member made of a plurality of materials comprising a portion of a ball striking surface and a portion of the crown surface, wherein the face member may be made of at least a second material and third material where the third material is located within the portion of the crown of the face member.

The second and third materials may have a modulus of elasticity lower than that of the first material.

According to one aspect, the golf club head having a club head body made of a first material and has a face member made of a plurality of materials wherein the face member comprises at least a portion of a ball striking surface and a flange that includes a portion of the crown. The face member comprises at least a second material and a third material, wherein the second material comprises a portion of the striking face while the third material comprises a portion of the crown. The third material having a modulus of elasticity lower than the modulus of elasticity of the first material.

Other aspects of the disclosure relate to a golf club or other ball striking device including a head or other ball striking device as described above and a shaft connected to the head/device and configured for gripping by a user. Aspects of the disclosure relate to a set of golf clubs including at least one golf club as described above. Yet additional aspects of the disclosure relate to a method for manufacturing a ball striking device as described above, including assembling a head as described above and/or connecting a handle or shaft to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
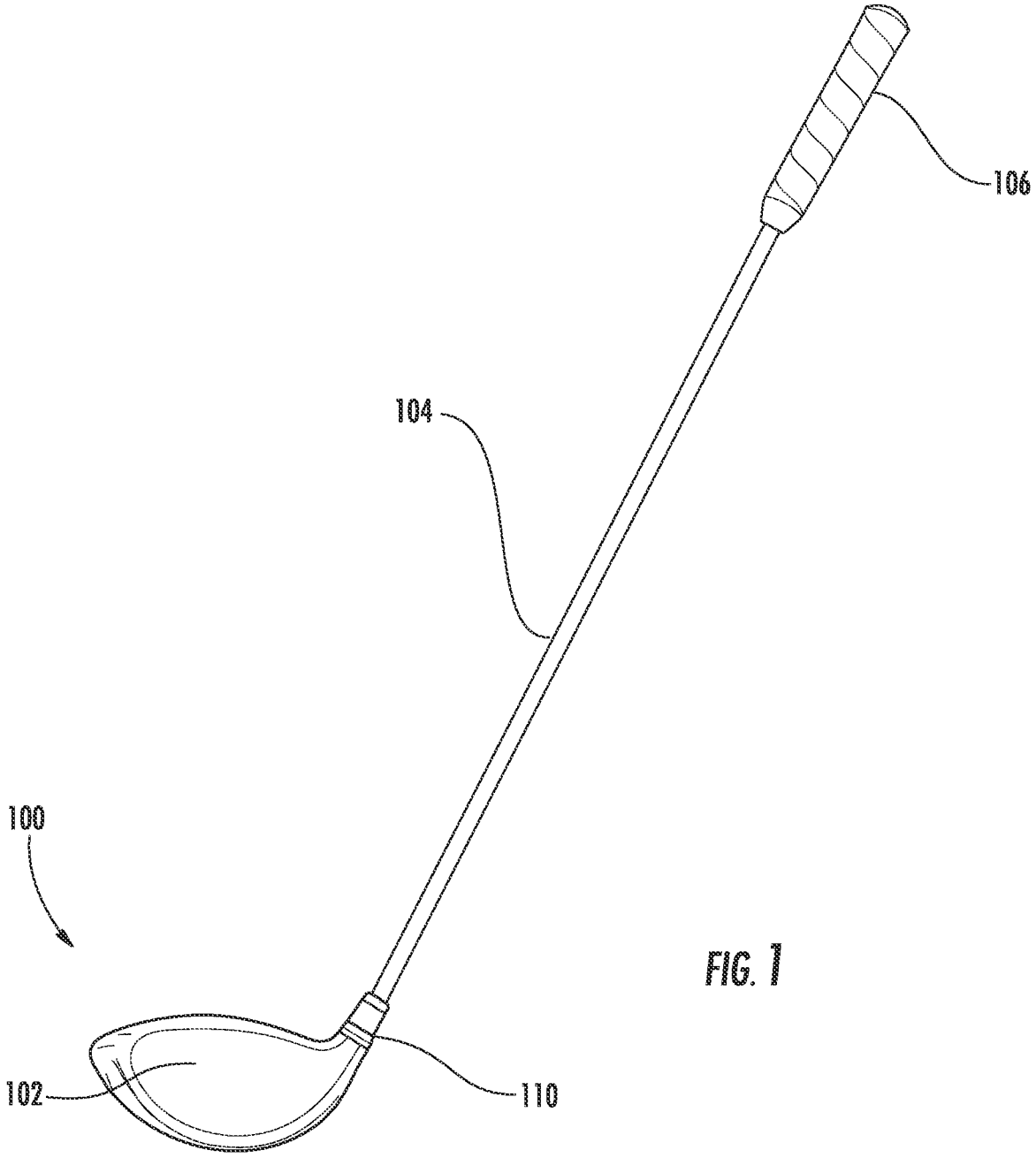
FIG. 1 is a front view of one embodiment of a golf club with a golf club head according to aspects of the disclosure, in the form of a golf club driver.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The terms "shaft" or "handle" include the portion of a ball striking device (if any) that the user holds during a swing of a ball striking device.

"Integral joining technique" or means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto. Pieces joined with such a technique are described as "integrally joined."

"Generally parallel" means that a first line, segment, plane, edge, surface, etc. 1s approximately (in this instance, within 5%) equidistant from with another line, plane, edge, surface, etc., over at least 50% of the length of the first line, segment, plane, edge, surface, etc.

"Substantially constant" when referring to a dimension means that a value 1s approximately the same and varies no more than +/−5%.

In general, aspects of this invention relate to ball striking devices, such as golf club heads, golf clubs, and the like. Such ball striking devices, according to at least some examples of the invention, may include a ball striking head with a ball striking surface. In the case of a golf club, the ball striking surface is a substantially flat surface on one face of the ball striking head. Some more specific aspects of this invention relate to wood-type golf clubs and golf club heads, including drivers, fairway woods, hybrid clubs, and the like, although aspects of this invention also may be practiced in connection with iron-type clubs, putters, and other club types as well.

According to various aspects and embodiments, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys, metal matrix composites, and other metallic materials). It is understood that the head may contain components made of several different materials, including carbon-fiber composites, polymer materials, and other components. Additionally, the components may be formed by various forming methods. For example, metal components, such as components made from titanium, aluminum, titanium alloys, aluminum alloys, steels (including stainless steels), and the like, may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, fairway woods and hybrid clubs, as well as other types of wood-type clubs. Such devices may include a one-piece construction or a multiple-piece construction. Example structures of ball striking devices according to this invention will be described in detail below in conjunction with FIGS. 1-10, which show one illustrative embodiment of a ball striking device 100 in the form of a wood-type golf club (e.g. a driver). FIGS. 11-17 illustrate alternate embodiments of a driver version of golf club head 102. As mentioned previously, aspects of this disclosure may alternately be used in connection with long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters.

The golf club 100 shown in FIG. 1 includes a golf club head or a ball striking head 102 configured to strike a ball in use and a shaft 104 connected to the ball striking head 102 and extending therefrom. FIGS. 1-10 illustrate one embodiment of a ball striking head in the form of a golf club head 102 that has a club head body 108 made of a first material connected to a face member 112 made of a plurality of materials, with a hosel 110 extending therefrom and a shaft 104 connected to the hosel 110. For reference, the head 102 generally has a top or crown 116, a bottom or sole 118, a heel 120 proximate the hosel 110, a toe 122 distal from the hosel 110, a front 124, and a back or rear 126, as shown in FIGS. 1-10. The shape and design of the head 102 may be partially dictated by the intended use of the golf club 100. For example, it is understood that the sole 118 is configured to face the playing surface in use. With clubs that are configured to be capable of hitting a ball resting directly on the playing surface, such as a fairway wood, hybrid, iron, etc., the sole 118 may contact the playing surface in use, and features of the club may be designed accordingly. In the club 100 shown in FIGS. 1-10, the head 102 has an enclosed volume, measured per "USGA PROCEDURE FOR MEASURING THE CLUB HEAD SIZE OF WOOD CLUBS", TPX-3003, REVISION 1.0.0 dated Nov. 21, 2003, as the club 100 is a wood-type club designed for use as a driver, intended to hit the ball long distances. In this procedure, the volume of the club head is determined using the displaced water weight method. According to the procedure, any large concavities must be filled with clay or dough and covered with tape so as to produce a smooth contour prior to measuring volume. Club head volume may additionally or alternately be calculated from three-dimensional computer aided design (CAD) modeling of the golf club head. In other applications, such as for a different type of golf club, the head 102 may be designed to have different dimensions and configurations. For example, when configured as a driver, the club head 102 may have a volume of at least 400 cc, and in some structures, at least 450 cc, or even at least 500 cc. The head 102 illustrated in the form of a driver in FIGS. 1-17 has a volume of approximately 460 cc. If instead configured as a fairway wood, the head may have a volume of 120 cc to 250 cc, and if configured as a hybrid club, the head may have a volume of 85 cc to 170 cc. Other appropriate sizes for other club heads may be readily determined by those skilled in the art. The loft angle of the club head 102 also may vary, e.g., depending on the distance the club 100 is designed to hit the ball. For example, a driver golf club head may have a loft angle range of 7 degrees to 16 degrees, a fairway wood golf club head may have a loft angle range of 12 to 25 degrees, and a hybrid golf club head may have a loft angle range of 16 to 32 degrees.

The body 108 of the head 102 can have various different shapes, including a rounded shape, as in the head 102 shown in FIGS. 1-17, a generally square or rectangular shape, or any other of a variety of other shapes. It is understood that such shapes may be configured to distribute weight in any desired, manner, e.g., away from the ball striking surface 114 and/or the geometric/volumetric center of the head 102, to create a lower center of gravity and/or a higher moment of inertia.

In the illustrative embodiment illustrated in FIGS. 1-17, the head 102 has a hollow structure defining an inner cavity 103 (e.g., defined by the face member 112 and the club head body 108) with a plurality of inner surfaces defined therein. In one embodiment, the inner cavity 103 may be filled with air. However, in other embodiments, the inner cavity 103 could be filled or partially filled with another material, such as foam or hot melt glue. In still further embodiments, the solid materials of the head may occupy a greater proportion of the volume, and the head may have a smaller cavity or no inner cavity 103 at all. It is understood that the inner cavity 103 may not be completely enclosed in some embodiments.

Figure 3:
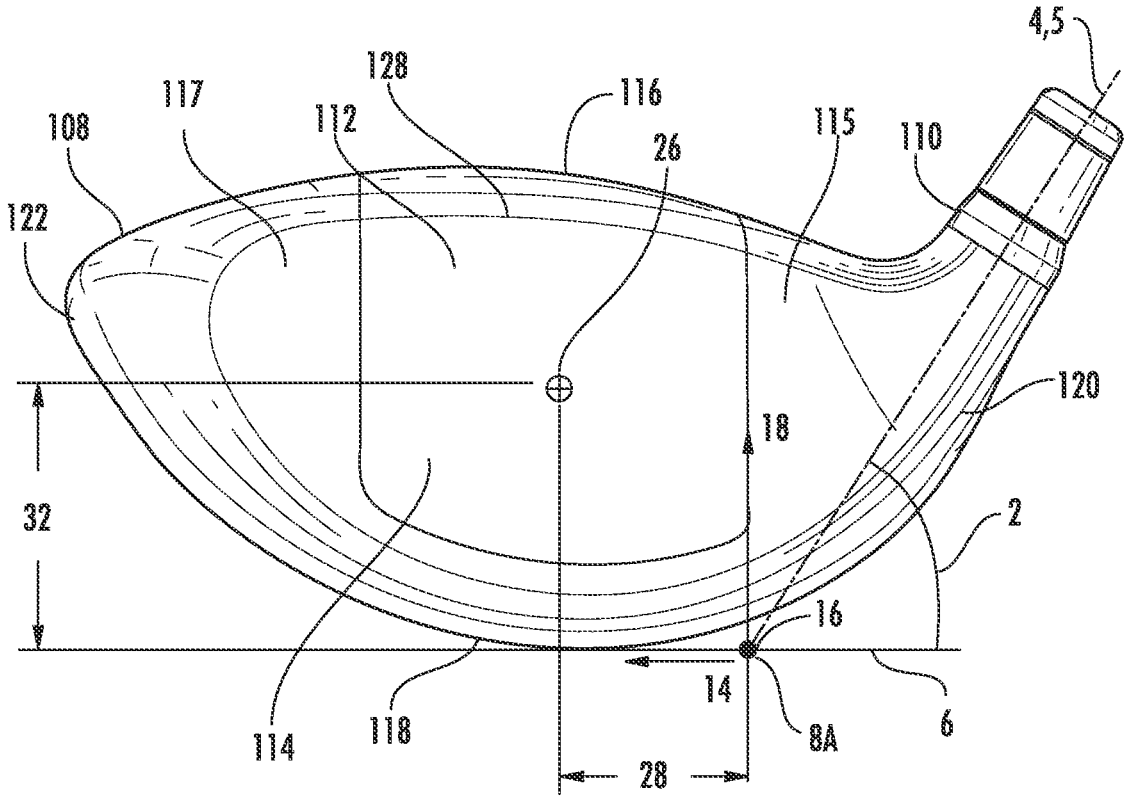
FIG. 3 is a front view of the club head of FIG. 1, showing a ground plane origin point.

The face member 112 is located at the front 124 of the head 102 and comprises a portion of the ball striking surface (or striking surface) 111 located thereon, an inner surface 107 opposite the ball striking surface 111, and a flange 130 as illustrated in FIG. 3. The edges 128 of the ball striking surface may be defined as the boundaries of an area of the ball striking surface 114 that is specifically designed to contact the ball in use, and may be recognized as the boundaries of an area of the ball striking surface 114 that is intentionally shaped and configured to be suited for ball contact. The ball striking surface 114 comprises a portion of the ball striking surface 111 of face member 112 along with the other portions of the ball striking surface at the toe 117 and at the heel 115 within the peripheral edge 128. The face member's ball striking surface 111 may make up at least 70 percent of the surface area of the ball striking surface 114, or at least 80 percent of the surface area of the ball striking surface 114, or 100 percent of the surface area of the ball striking surface 114.

The face member 112 may be made of a plurality of members, where a first member 132 made of a first material comprises a portion of the striking face and a flange 130 which includes a portion of the crown adjacent to the striking face and a second member 134 made of a second material contained within the flange 130 that comprises a portion of the crown surface 116. The second material may have a lower modulus of elasticity than the first material. For example, the first member 132 comprising the ball striking surface portion 111 and a portion of the flange 130 may be made of the same material as the material that makes up the club head body 108 like a titanium alloy such as Ti-6Al-4V alloy and the second member 134 may be a second material with a lower modulus of elasticity such as a beta titanium alloy, gum Metal™, vitreous alloys, metallic glasses or other amorphous metallic materials, composite materials (carbon fiber and others), or other suitable material. Alternatively, the flange 130 may be made entirely of a lower modulus material where the ball striking face 111 is a first material and the flange is the second material.

The modulus of elasticity is a measurement of a material's resistance to a force and not be permanently deformed. The higher the modulus of elasticity, the stiffer the material. By having a modulus of elasticity lower than that of the first material, the second member creates an area that may deform greater than the surrounding area during the impact with a golf ball. This deformation within the body, as long as it does not cause permanent deformation of the material, may improve the efficiency of the collision or COR by keeping the ball from losing as much energy during the impact with a golf club.

The material of the club head body may be a titanium alloy. Titanium alloys may have a variety of modulus of elasticity properties, but typically range between 100 GPa and 140 GPa. For example, the modulus of elasticity of common titanium alpha-beta alloys, such as Ti-6Al-4V alloy, is approximately 114 GPa, while Ti-8Al-1Mo-1V, which is an alpha/near alpha alloy, has a modulus of approximately 121 GPa. A typical beta titanium alloy such as Ti-15V-3Cr-3Sn-3Al has a modulus of approximately 100 GPa. Additionally, the modulus of elasticity may be affected by work hardening a titanium alloy and aligning the grain structure in a specific direction. For example, the titanium alloy SP700 from JFE steel may have a modulus of elasticity ranging from approximately 109 GPa to 137 GPa depending upon the direction the grain is oriented after cold working.

However, gum Metal™ is a unique titanium alloy that has a combination of a relatively low modulus of elasticity and a yield strength comparable or higher than titanium alloys. Gum Metal™ may have a modulus of elasticity of approximately 80 GPa or in a range of 85 GPa to 95 GPa, but the modulus of elasticity may be modified by a work hardening process, like cold working, to approximately 45 GPa, or in a range between 30 GPa and 60 GPa. However, gum Metal™ may have a density of approximately 5.6 grams per cubic centimeter, which is higher than that of a titanium alloy, which may be within a range of 4.5 to 4.8 grams per cubic centimeter. This lower modulus of elasticity combined with its high yield strength may make it an ideal material to provide an elastically deformable region in the golf club body, while the higher density may restrict the use of gum Metal™ to targeted regions.

Additionally, the relationship between the material of the second member 134 to the material of the first member 132 or the material of the club head body 108 may be such that the modulus of elasticity of the material of the second member 134 may be at least 5% lower than the material of the first member 132 or the material of the club head body, or at least 10% lower, or even at least 20% lower. The modulus of the material is recognized to be in the proper heat treatment condition of the finished golf club head to enable the golf club head to be durable, as one skilled in the art would define it.

The golf club head 102 may be formed of using a method with the steps of (a) forming a golf club head body 108 of a first material comprising a heel 120, a toe 122, a sole 118, and a portion of a crown 116; (b) integrally joining a plurality of materials to form a compound material; (c) forming a face member 112 comprising a ball striking surface 111 and a portion of the crown 116 from the compound material; (d) connecting the golf club head body and the face member using an integral joining technique. The compound material may be formed to a near final shape required by the face member 112 by a cold forming, pressing, stamping or forging type process.

Additionally, the ball striking surface portion 111 of the face member 112 may have constant thickness or it may have variable thickness. In one embodiment, the face member 112 of the head 102 in FIGS. 1-17 may be made from titanium alloy (e.g., Ti-6Al-4V alloy or Ti-15V-3Cr-3Sn-3Al other alloy); however, the face member 112 may be made from other materials in other embodiments such as a steel, carbon composite or even carbon fiber reinforced polymer.

It is understood that the face member 112, the body 108, and/or the hosel 110 can be formed as a single piece or as separate pieces that are joined together. The body 108 being partially or wholly formed by one or more separate pieces connected to the face member. These pieces may be connected by an integral joining technique, such as welding, cementing, or adhesively joining. Other known techniques for joining these parts can be used as well, including many mechanical joining techniques, including releasable mechanical engagement techniques. As one example, a body 108 may be formed of a single, integral, cast piece may be connected to a face member 112 to define the entire club head. The head 102 in FIGS. 1-17 may be constructed using this technique, in one embodiment. As another example, a single, integral body member may be cast with an opening in the sole. The body member is then connected to a face member, and a separate sole piece is connected within the sole opening to completely define the club head. Such a sole piece may be made from the same material or a different material, beta-titanium, polymer or composite. As a further example, either of the above techniques may be used, with the body member having an opening on the top side thereof. A separate crown piece is used to cover the top opening and form part or the entire crown 116, and this crown piece may be made from the same material or a different material, beta-titanium, gum, polymer or composite. As yet another example, a first piece including the face member 112 and a portion of the body 108 may be connected to one or more additional pieces to further define the body 108. For example, the first piece may have an opening on the top and/or bottom sides, with a separate piece or pieces connected to form part or all of the crown 116 and/or the sole 118. Further, different forming techniques may be used in other embodiments.

Figure 2:
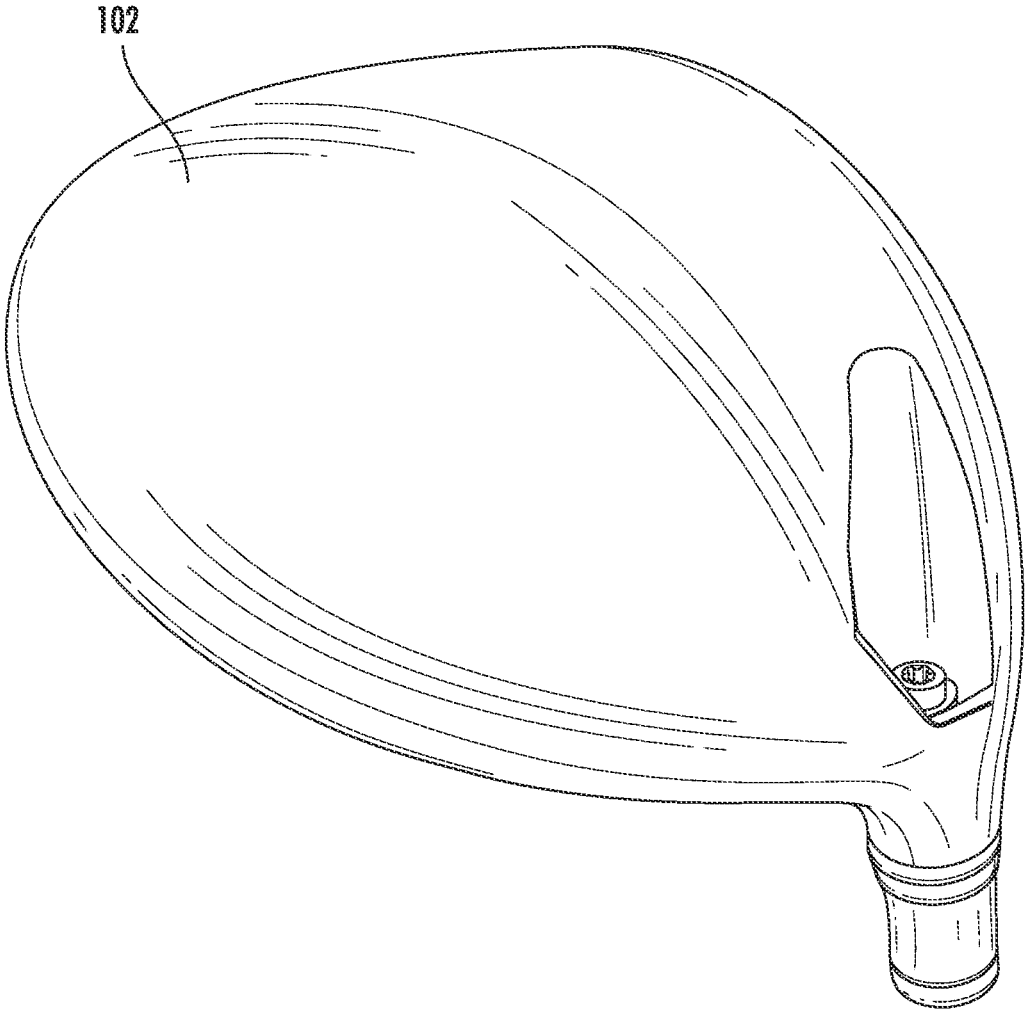
FIG. 2 is a bottom right rear perspective view of the golf club head of FIG. 1.

The golf club 100 may include a shaft 104 connected to or otherwise engaged with the ball striking head 102 as shown in FIG. 1. The shaft 104 is adapted to be gripped by a user to swing the golf club 100 to strike the ball. The shaft 104 can be formed as a separate piece connected to the head 102, such as by connecting to the hosel 110, as shown in FIG. 1. Any desired hosel and/or head/shaft interconnection structure may be used without departing from this invention, including conventional hosel or other head/shaft interconnection structures as are known and used in the art, or an adjustable, releasable, and/or interchangeable hosel or other head/shaft interconnection structure such as those shown and described in U.S. Patent Application Publication No. 2009/0062029, filed on Aug. 28, 2007, U.S. Patent Application Publication No. 2013/0184098, filed on Oct. 31, 2012, and U.S. Pat. No. 8,533,060, issued Sep. 10, 2013, all of which are incorporated herein by reference in their entireties and made parts hereof. The head 102 may have an opening or other access 128 for the adjustable hosel 110 connecting structure that extends through the sole 118, as shown in FIG. 2. In other illustrative embodiments, at least a portion of the shaft 104 may be an integral piece with the head 102, and/or the head 102 may not contain a hosel 110, may contain an internal hosel structure, or may not extend through the sole 118. Still further embodiments are contemplated without departing from the scope of the invention.

The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element 106 may be positioned on the shaft 104 to provide a golfer with a slip resistant surface with which to grasp the golf club shaft 104, as seen in FIG. 1. The grip element may be attached to the shaft 104 in any desired manner, including in conventional manners known and used in the art (e.g., via adhesives or cements, threads or other mechanical connectors, swedging/swaging, etc.).

The various embodiments of golf clubs 100 and/or golf club heads 102 described herein may include components that have sizes, shapes, locations, orientations, etc., that are described with reference to one or more properties and/or reference points. Several of such properties and reference points are described in the following paragraphs, with reference to FIGS. 3-9.

As illustrated in FIG. 3, a lie angle 2 is defined as the angle formed between the hosel axis 4 or a shaft axis 5 and a horizontal plane contacting the sole 118, i.e., the ground plane 6. It is noted that the hosel axis 4 and the shaft axis 5 are central axes along which the hosel 110 and shaft 104 extend.

Figure 4:
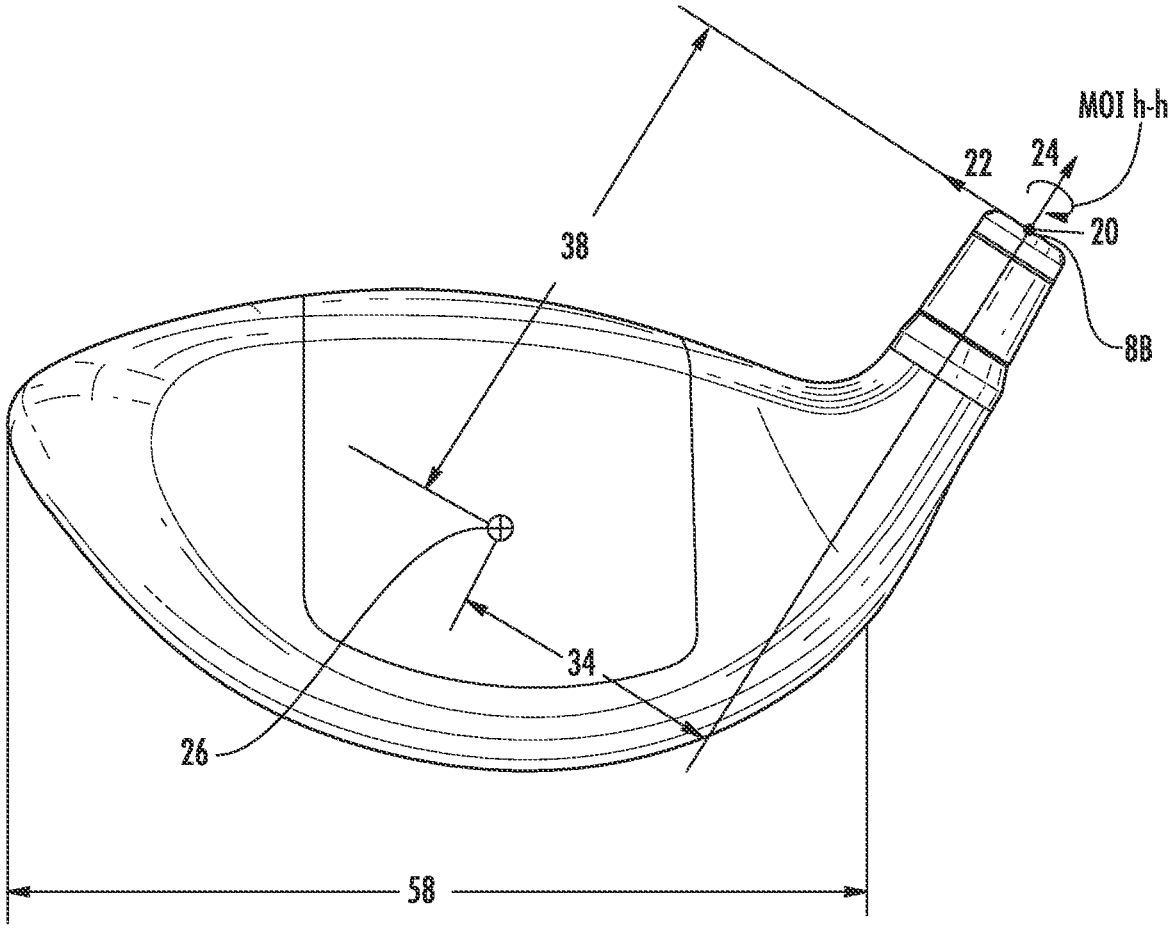
FIG. 4 is a front view of the club head of FIG. 1, showing a hosel origin point.

One or more origin points 8 (e.g., 8A, 8B) may be defined in relation to certain elements of the golf club 100 or golf club head 102. Various other points, such as a center of gravity, a sole contact, and a face center, may be described and/or measured in relation to one or more of such origin points 8. FIGS. 3 and 4 illustrate two different examples such origin points 8, including their locations and definitions. A first origin point location, referred to as a ground plane origin point 8A is generally located at the ground plane 6. The ground plane origin point 8A is defined as the point at which the ground plane 6 and the hosel axis 4 intersect. A second origin point location, referred to as a hosel origin point 8B, is generally located on the hosel 110. The hosel origin point 8B is defined on the hosel axis 4 and coincident with the uppermost edge of the hosel 110. Either location for the origin point 8, as well as other origin points, may be utilized for reference without departing from this invention. It is understood that references to the ground plane origin point 8A and hosel origin point 8B are used herein consistent with the definitions in this paragraph, unless explicitly noted otherwise. Throughout the remainder of this application, the ground plane origin point 8A will be utilized for all reference locations, tolerances, calculations, etc., unless explicitly noted otherwise.

As illustrated in FIG. 3, a coordinate system may be defined with an origin located at the ground plane origin point 8A, referred to herein as a ground plane coordinate system. In other words, this coordinate system has an X-axis 14, a Y-axis 16, and a Z-axis 18 that all pass through the ground plane origin point 8A. The X-axis in this system is parallel to the ground plane and generally parallel to the striking surface 114 of the golf club head 102. The Y-axis 16 in this system is perpendicular to the X-axis 14 and parallel to the ground plane 6, and extends towards the rear 126 of the golf club head 102, i.e., perpendicular to the plane of the drawing sheet in FIG. 3. The Z-axis 18 in this system is perpendicular to the ground plane 6, and may be considered to extend vertically. Throughout the remainder of this application, the ground plane coordinate system will be utilized for all reference locations, tolerances, calculations, etc., unless explicitly noted otherwise.

Figure 5:
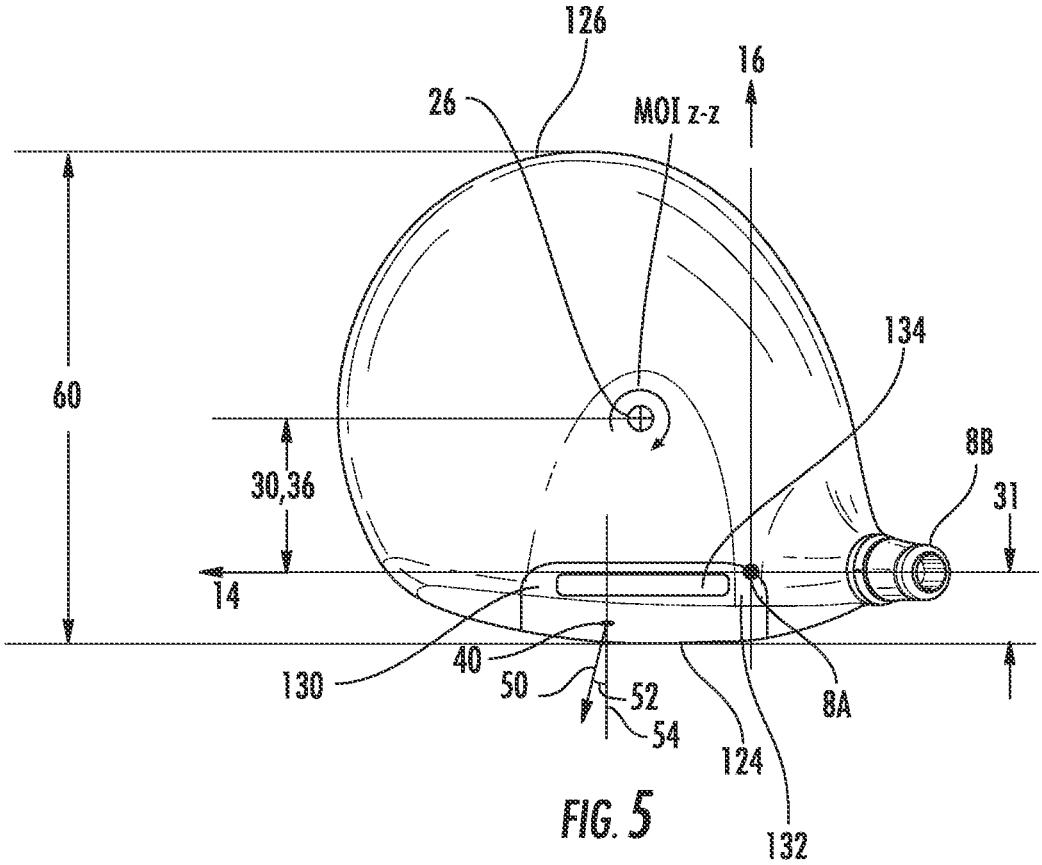
FIG. 5 is a top view of the club head of FIG. 1.

FIGS. 3 and 5 illustrate an example of a center of gravity location 26 as a specified parameter of the golf club head 102, using the ground plane coordinate system. The center of gravity of the golf club head 102 may be determined using various methods and procedures known and used in the art. The golf club head 102 center of gravity location 26 is provided with reference to its position from the ground plane origin point 8A. As illustrated in FIGS. 3 and 5, the center of gravity location 26 is defined by a distance CGX 28 from the ground plane origin point 8A along the X-axis 14, a distance CGY 30 from the ground plane origin point 8A along the Y-axis 16, and a distance CGZ 32 from the ground plane origin point 8A along the Z-axis 18.

Additionally as illustrated in FIG. 4, another coordinate system may be defined with an origin located at the hosel origin point 8B, referred to herein as a hosel axis coordinate system. In other words, this coordinate system has an X' axis 22, a Y' axis 20, and a Z' axis 24 that all pass through the hosel origin point 8B. The Z' axis 24 in this coordinate system extends along the direction of the shaft axis 5 (and/or the hosel axis 4). The X' axis 22 in this system extends parallel with the vertical plane and normal to the Z' axis 24. The Y' axis 20 in this system extends perpendicular to the X' axis 22 and the Z' axis 24 and extends toward the rear 126 of the golf club head 102, i.e., the same direction as the Y-axis 16 of the ground plane coordinate system.

FIG. 4 illustrates an example of a center of gravity location 26 as a specified parameter of the golf club head 102, using the hosel axis coordinate system. The center of gravity of the golf club head 102 may be determined using various methods and procedures known and used in the art. The golf club head 102 center of gravity location 26 is provided with reference to its position from the hosel origin point 8B. As illustrated in FIG. 4, the center of gravity location 26 is defined by a distance X 34 from the hosel origin point 8B along the X' axis 22, a distance Y (not shown) from the hosel origin point 8B along the Y' axis 20, and a distance Z 38 from the hosel origin point 8B along the Z' axis 24.

Figure 6:
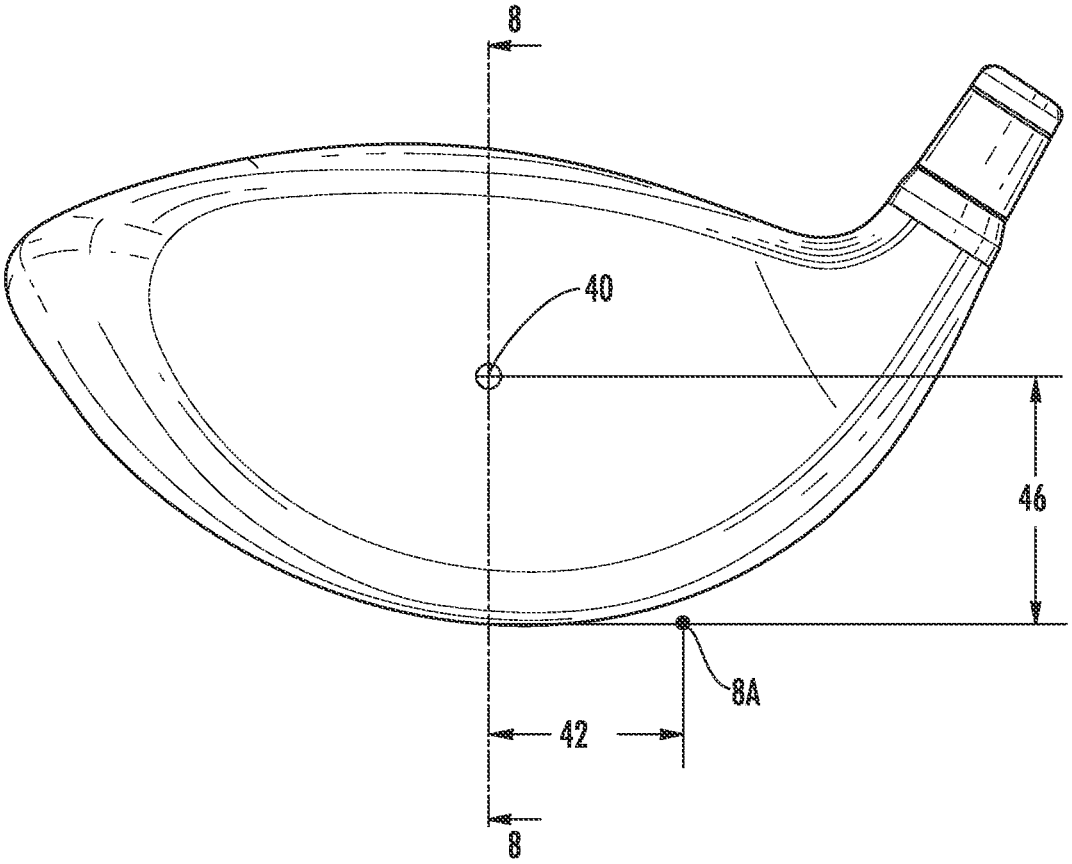
FIG. 6 is a front view of the club head of FIG. 1.

FIGS. 5 and 6 illustrate the face center (FC) location 40 on a golf club head 102. The face center location 40 illustrated in FIGS. 4 and 5 is determined using United States Golf Association (USGA) standard measuring procedures from the "Procedure for Measuring the Flexibility of a Golf Clubhead", USGA TPX-3004, Revision 2.0, Mar. 25, 2005. Using this USGA procedure, a template is used to locate the FC location 40 from both a heel 120 to toe 122 location and a crown 116 to sole 118 location. For measuring the FC location 40 from the heel-to-toe location, the template should be placed on the striking surface 114 until the measurements at the edges of the striking surface 114 on both the heel 120 and toe 122 are equal. This marks the FC location 40 from a heel-to-toe direction. To find the face center from a crown to sole dimension, the template is placed on the striking surface 114 and the FC location 40 from crown to sole is the location where the measurements from the crown 116 to sole 118 are equal. The FC location 40 is the point on the striking surface 114 where the crown-to-sole measurements on the template are equidistant, and the heel-to-toe measurements are equidistant.

As illustrated in FIGS. 5 and 6, the FC location 40 can be defined from the ground plane origin coordinate system, such that a distance CFX 42 is defined from the ground plane origin point 8A along the X-axis 14, a distance CFY 44 is defined from the ground plane origin point 8A along the Y-axis 16, and a distance CFZ 46 is defined from the ground plane origin point 8A along the Z-axis 18. It is understood that the FC location 40 may similarly be defined using the hosel origin system, if desired. The face progression (FP) 31 may be determined as the distance from the center axis of the hosel or origin point 8A to the forward most edge of the head 102 along the Y-Axis 16.

Figure 7:
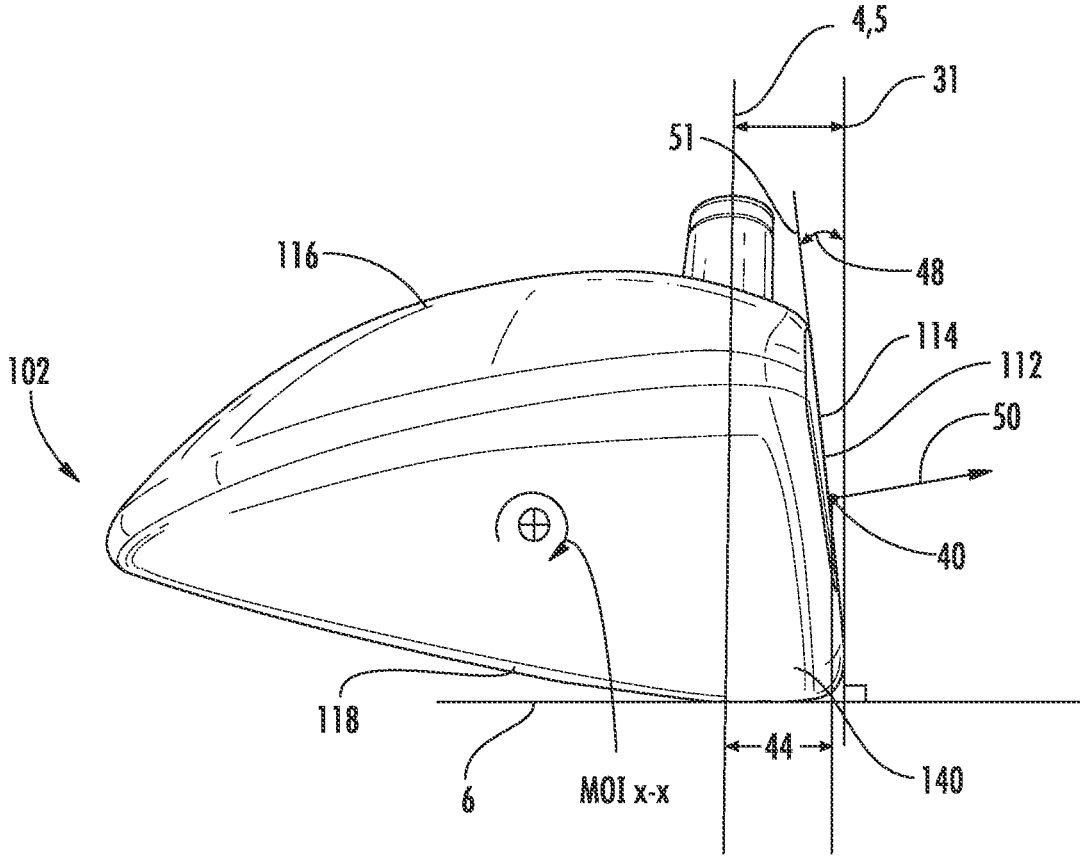
FIG. 7 is a side view of the club head of FIG. 1.

FIG. 7 illustrates an example of a loft angle 48 of the golf club head 102. The loft angle 48 can be defined as the angle between plane 51 that is tangential to the club head at the FC location 40 and a plane normal or perpendicular to the ground plane 6. Alternately, the loft angle 48 can be defined as the angle between an axis 50 normal or perpendicular to the striking surface 114 at the FC location 40, called a face center axis 50, and the ground plane 6. It is understood that each of these definitions of the loft angle 48 may yield the substantially the same loft angle measurement.

FIG. 5 illustrates an example of a face angle 52 of a golf club head 102. As illustrated in FIG. 5, the face angle 52 is defined as the angle between the face center axis 50 and a plane 54 perpendicular to the X-axis 14 and the ground plane 6.

FIG. 3 illustrates a golf club head 102 oriented in a reference position. In the reference position, the hosel axis 4 or shaft axis 5 lies in a vertical plane, as shown in FIG. 7. As illustrated in FIG. 3, the hosel axis 4 may be oriented at the lie angle 2. The lie angle 2 selected for the reference position may be the golf club 100 manufacturer's specified lie angle. If a specified lie angle is not available from the manufacturer, a lie angle of 60 degrees can be used. Furthermore, for the reference position, the striking surface 114 may, in some circumstances, be oriented at a face angle 54 of 0 degrees. The measurement setup for establishing the reference position can be found determined using the "Procedure for Measuring the Club Head Size of Wood Clubs", TPX-3003, and Revision 1.0.0, dated Nov. 21, 2003.

As golf clubs have evolved in recent years, many have incorporated head/shaft interconnection structures connecting the shaft 104 and club head 102. These interconnection structures are used to allow a golfer to easily change shafts for different flex, weight, length or other desired properties. Many of these interconnection structures have features whereby the shaft 104 is connected to the interconnection structure at a different angle than the hosel axis 4 of the golf club head, including the interconnection structures discussed elsewhere herein. This feature allows these interconnection structures to be rotated in various configurations to potentially adjust some of the relationships between the club head 102 and the shaft 104 either individually or in combination, such as the lie angle, the loft angle, or the face angle. As such, if a golf club 100 includes an interconnection structure, it shall be attached to the golf club head when addressing any measurements on the golf club head 102. For example, when positioning the golf club head 102 in the reference position, the interconnection structures should be attached to the structure. Since this structure can influence the lie angle, face angle, and loft angle of the golf club head, the interconnection member shall be set to its most neutral position. Additionally, these interconnection members have a weight that can affect the golf club heads mass properties, e.g. center of gravity (CG) and moment of inertia (MOI) properties. Thus, any mass property measurements on the golf club head should be measured with the interconnection member attached to the golf club head.

The moment of inertia is a property of the club head 102, the importance of which is known to those skilled in the art. There are three moment of inertia properties referenced herein. The moment of inertia with respect to an axis parallel to the X-axis 14 of the ground plane coordinate system, extending through the center of gravity 26 of the club head 102, is referenced as the MOI x-x, as illustrated in FIG. 7. The moment of inertia with respect to an axis parallel to the Z-axis 18 of the ground plane coordinate system, extending through the center of gravity 26 of the club head 102, is referenced as the MOI z-z, as illustrated in FIG. 5. The moment of inertia with respect to the Z' axis 24 of the hosel axis coordinate system is referenced as the MOI h-h, as illustrated in FIG. 4. The MOI h-h can be utilized in determining how the club head 102 may resist the golfer's ability to close the club face during the swing.

Figures 8, 8A:
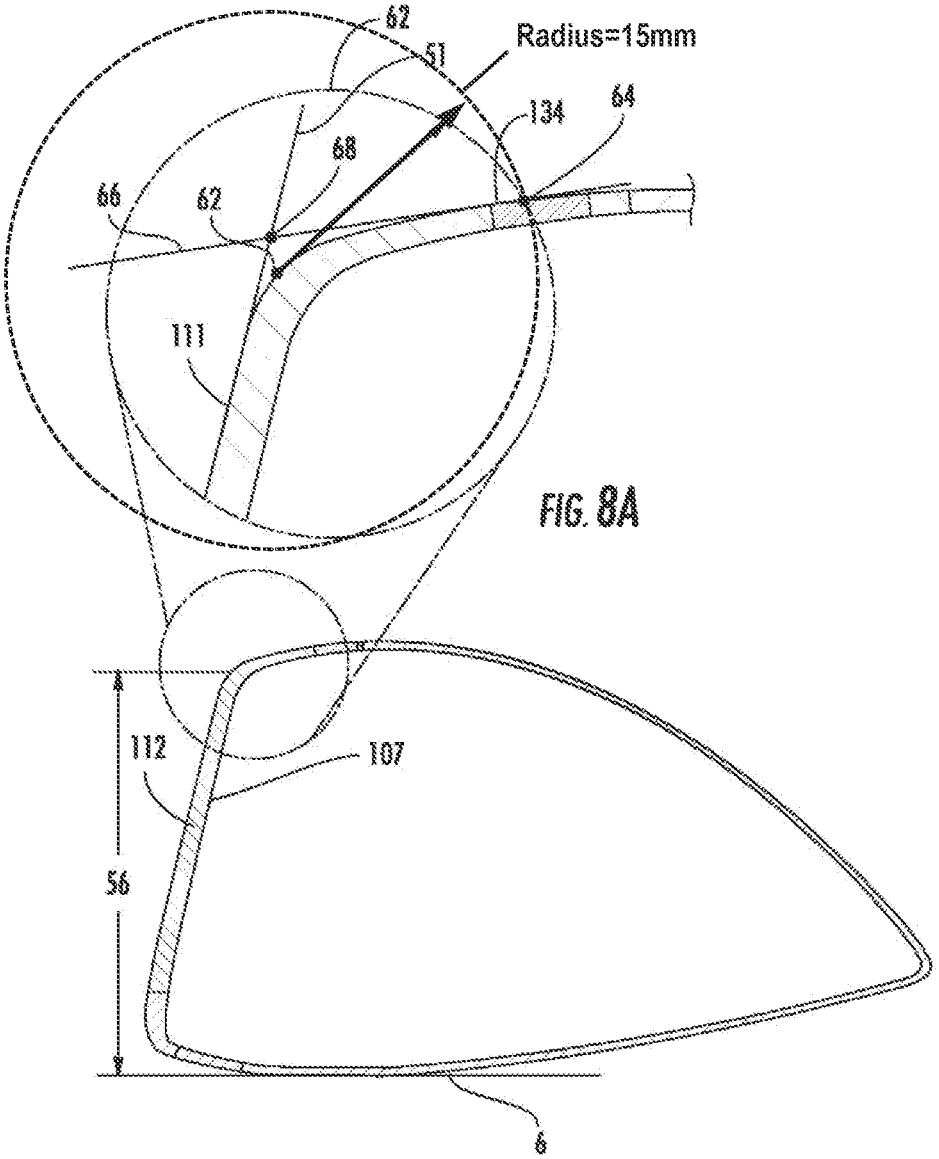
FIG. 8 is a cross-section view taken along line 8-8 of FIG. 6, with a magnified portion also shown as FIG. 8A.
Figure 9:
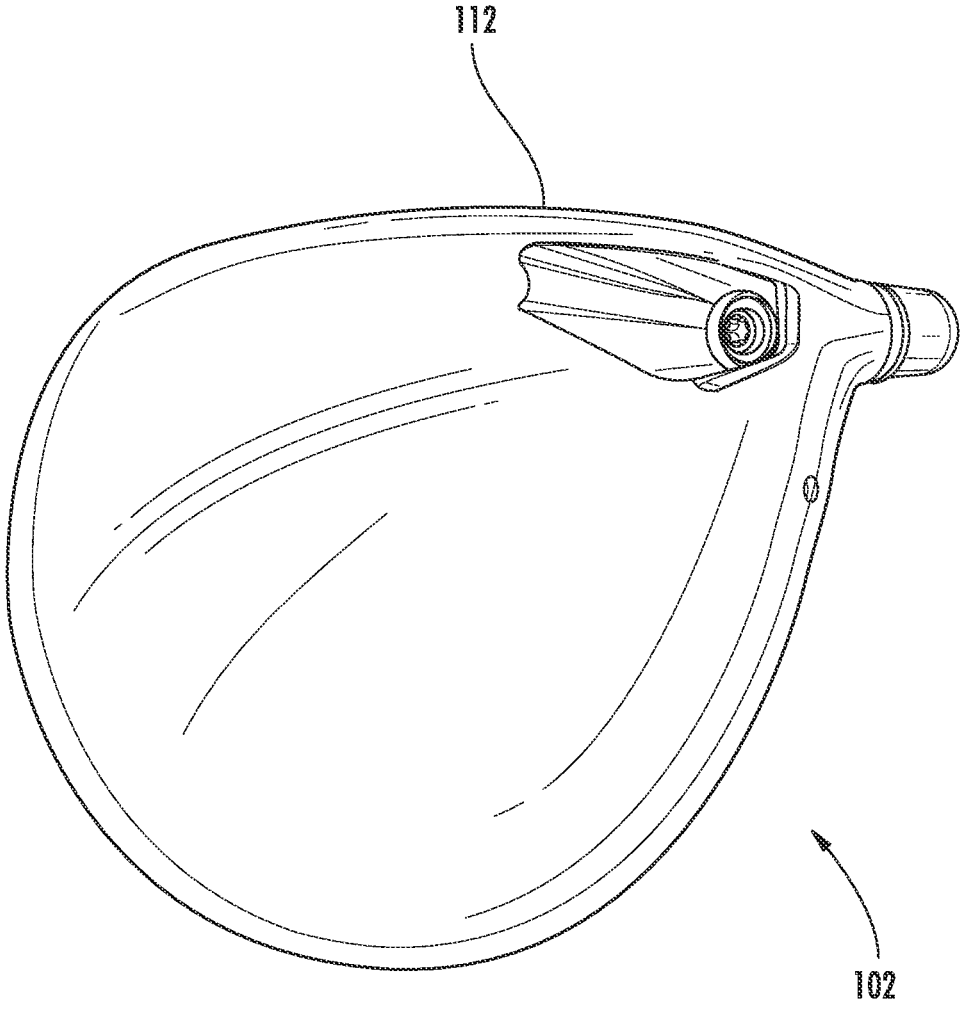
FIG. 9 is a bottom view of the club head of FIG. 1.

The ball striking face height (FH) 56 is a measurement taken along a plane normal to the ground plane and defined by the dimension CFX 42 through the face center 40, of the distance between the ground plane 6 and a point represented by a midpoint 62 of a radius between the crown 116 and the face member 112. An example of the measurement of the face height 56 of a head 102 is illustrated in FIG. 8. It is understood that the club heads 102 described herein may be produced with multiple different loft angles, and that different loft angles may have some effect on face height 56.

The crown-face intersection point 68 may be taken along a plane normal to the ground plane and defined by the dimension CFX 42 through the face center 40 as shown in FIG. 8A. A reference point on the crown must be defined to determine the proper crown and face intersection point. Starting with a midpoint 62 of the radius between the flange 130 or crown surface 116 and the ball striking surface 114, a circle with a radius of 15 mm is projected onto the crown surface to find a circle-crown intersection point 64. A line 66 is then projected from this circle-crown intersection point 64 along a direction parallel to the curvature at that crown and circle-crown intersection point 64. The crown-face intersection point 68 is determined as the intersection of the line 66 and the plane 51 that is tangential to the club head at the FC location 40.

The head length 58 and head breadth 60 measurements can be determined by using the USGA "Procedure for Measuring the Club Head Size of Wood Clubs," USGA-TPX 3003, Revision 1.0.0, dated Nov. 21, 2003. Examples of the measurement of the head length 58 and head breadth 60 of a head 102 are illustrated in FIGS. 4 and 5.

In the golf club 100 shown in FIGS. 1-17, the head 102 has dimensional characteristics that define its geometry and also has specific mass properties that can define the performance of the golf club as it relates to the ball flight that it imparts onto a golf ball during the golf swing or the impact event itself. This illustrative embodiment and other embodiments are described in greater detail below.

The head 102 as shown in FIGS. 1-17 illustrates a driver golf club head. The head 102 may have a head weight of approximately 198 to 210 grams, or 190 to 220 grams or even 188 to 240 grams. The head 102 may have an MOI x-x of approximately 2500 $g*cm^2$ to 2700 $g*cm^2$, or approximately 2400 $g*cm^2$ to 2800 $g*cm^2$, or approximately 2000 $g*cm^2$ to 3000 $g*cm^2$. Additionally, the head 102 may have an MOI z-z of approximately 4400 $g*cm^2$ to 4800 $g*cm^2$, or approximately 4200 $g*cm^2$ to 5000 $g*cm^2$, or approximately 4000 $g*cm^2$ to 5400 $g*cm^2$. The head 102 when configured as a driver generally has a head length ranging of approximately 119 mm, or in a range between 115 mm to 122 mm, or in a range of 105 mm to 132 mm and a head breadth of approximately 117 mm, or in a range between 113 mm to 119 mm, or in a range between 103 mm to 129 mm. Alternatively, the head 102 when configured as a fairway wood or hybrid may have a head length, breadth and MOI ranges lower than those of a driver.

Figure 10:
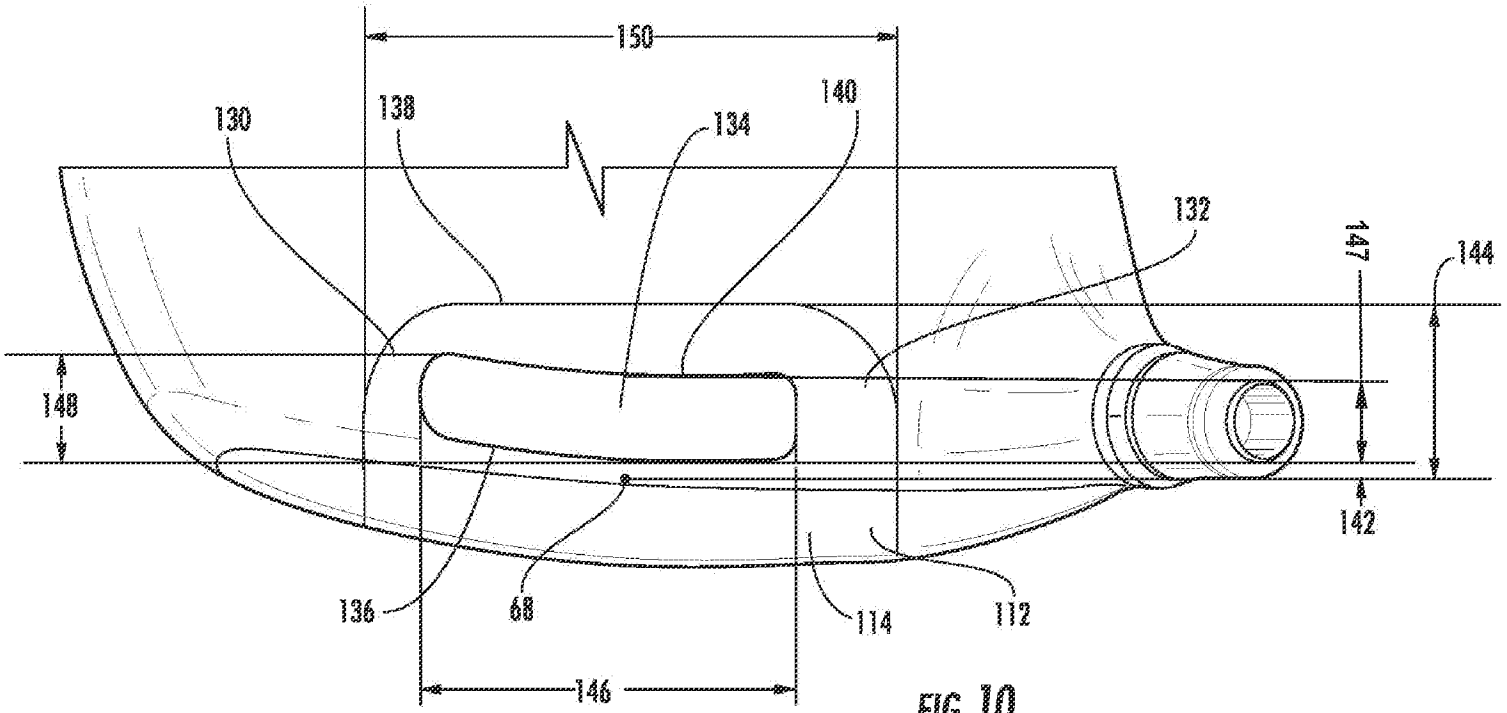
FIG. 10 is a magnified view of a portion of the club head of FIG. 5.

As FIG. 10 shows the flange 130 may be positioned where the rear edge 138 of the flange 130 is located a distance in the Y-Axis direction from the crown-face intersection point 68 given by dimension 144. The rear edge 138 may be a distance of approximately 20 mm, or in a range between 10 mm and 30 mm, or a range between 5 mm and 40 mm. The second member 134 of face member 112 has a generally rectangular shape or may be any shape. The corners of the second member 134 may have generous radii to avoid having sharp corners, thus limiting any stress concentrations. The forward most edge 136 of the second member 134 may have a forward most edge that is parallel to the ball striking surface 114. The ball striking surface 114 may have a bulge radius measuring from heel-to-toe and a roll radius measuring from crown to sole. This bulge and roll radii may measure between 200 mm to 460 mm. Alternatively, the forward most edge 136 of may be linear, in other words not have any curvature. The second member 134 may have a substantially constant width as the rear most edge 140 of the second member 134 is generally parallel to the forward most edge 136 with a width of approximately 7 mm, or in a range between 5 mm and 15 mm, or within a range of 4 mm to 20 mm. The forward most edge 136 may be located, when measured in the Y-Axis direction from the crown-face intersection point 68 to its most forward point of edge 136, a distance 142 of approximately 10 mm or may be in a range between 5 mm to 15 mm, or in a range between 2 mm to 25 mm. The second member 134 has a center width 147 when measured in a front-to-back (or Y-Axis direction) along a plane passing through the face center 40 between the forward most edge 136 and the rearward most edge 140 which may be approximately 8 mm, or in a range between 5 mm to 13 mm, or in a range between 3 mm to 18 mm. The maximum width dimension 148 of the second member 134 may be approximately 12 mm, or in a range between 8 mm to 20 mm, or in a range between 5 mm and 26 mm, when measured from the most forward point of edge 136 to the rear most point of edge 140.

Since golf clubs may be designed to have a bias help correct specific types of golf shots, such as designing to limit the effect of "a slice" or "a hook", the face member 112 may not be centered at the center of the face or the CFX location. Alternatively, the second member 134 may be centered at the CFX location. The length dimension 146 of the second member 134 may be at least 65 percent of the length dimension 150 of the flange the maximum length of the flange 130 or 90 percent or even the maximum length of the flange. The maximum length of the flange is defined as the longest dimension of the flange (or crown portion of the face member 112) in a heel-to-toe direction.

The thickness of the second member 134 may be equal to or less than the surrounding thickness of the flange 130 of the face member 112. The overall thickness of the flange 130 of the face member 112 may be constant or the flange 130 of the face member 112 may have a variable thickness. The thickness of the flange 130 may be approximately 1.5 mm, or may be within a range of 1.0 mm to 2.0 mm, or within a range of 0.8 mm to 2.2 mm.

Figure 11:
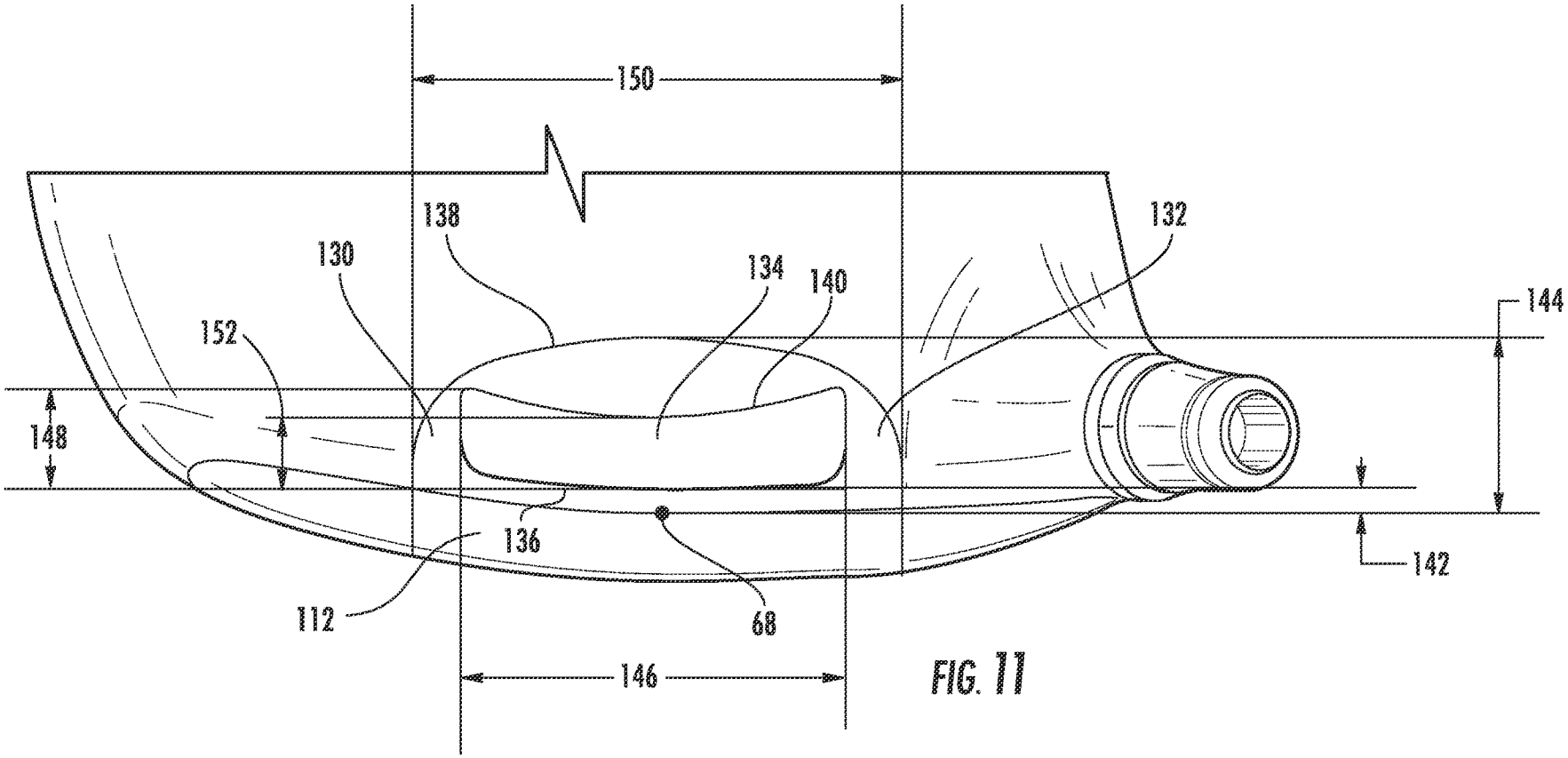
FIG. 11 is a magnified view of an alternate embodiment of a portion of the club head of FIG. 5.
Figure 12:
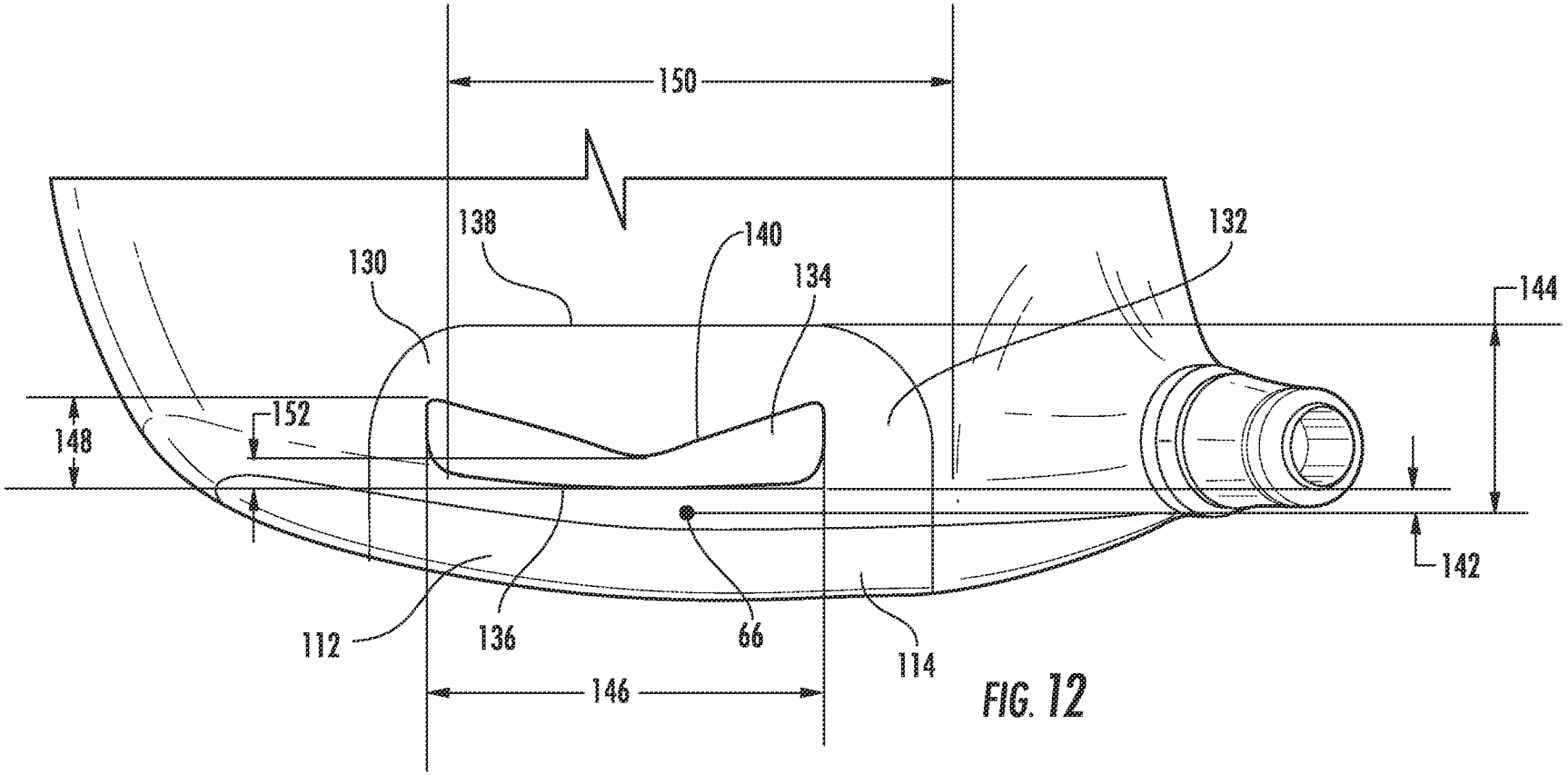
FIG. 12 is a magnified view of an alternate embodiment of a portion of the club head of FIG. 5.

FIG. 11 shows an additional embodiment of head 102 similar in length and thickness to the embodiment shown in FIG. 10, but where the second member 134 has variable width such that the width of the second member 134 increases as the second member moves towards the heel and toe creating a more flexible region on the heel and toe than in the center of the second member. The forward most edge 136 of the second member 134 may be parallel to the ball striking surface 114 or alternatively, the forward most edge 136 may be linear and not be parallel to the ball striking surface 114. The distance of the rear most edge 140 from the forward most edge 136 increases as the edge moves toward the heel and the toe. This increased distance may have a linear slope of as shown in FIG. 12 or may be a curved transition as shown in FIG. 11. The width at the heel and toe may be equal or have a width at the toe end of the second member that is greater than the width at the heel end or conversely, the width at the heel end may be greater than the width at the toe end. The maximum width dimension 146 of the second member may be approximately 15 mm, or a range between 10 to 20 mm, or a range between 5 mm and 26 mm. The minimum width dimension 152 of the second member 134 may be approximately 8 mm, or a range between 5 to 16 mm, or a range between 3 mm to 22 mm. The ratio of the maximum width dimension 148 to the minimum width dimension 152 may be approximately 2:1, or may be in the range of 1.3:1 and 3:1. The forward most edge 136 may be positioned, when measured in the Y-Axis direction from the crown-face intersection point 68 to the forward most point of edge 136 by dimension 142, approximately 10 mm or may be approximately in a range between 5 mm to 15 mm, or between 2 mm to 25 mm.

Figure 13:
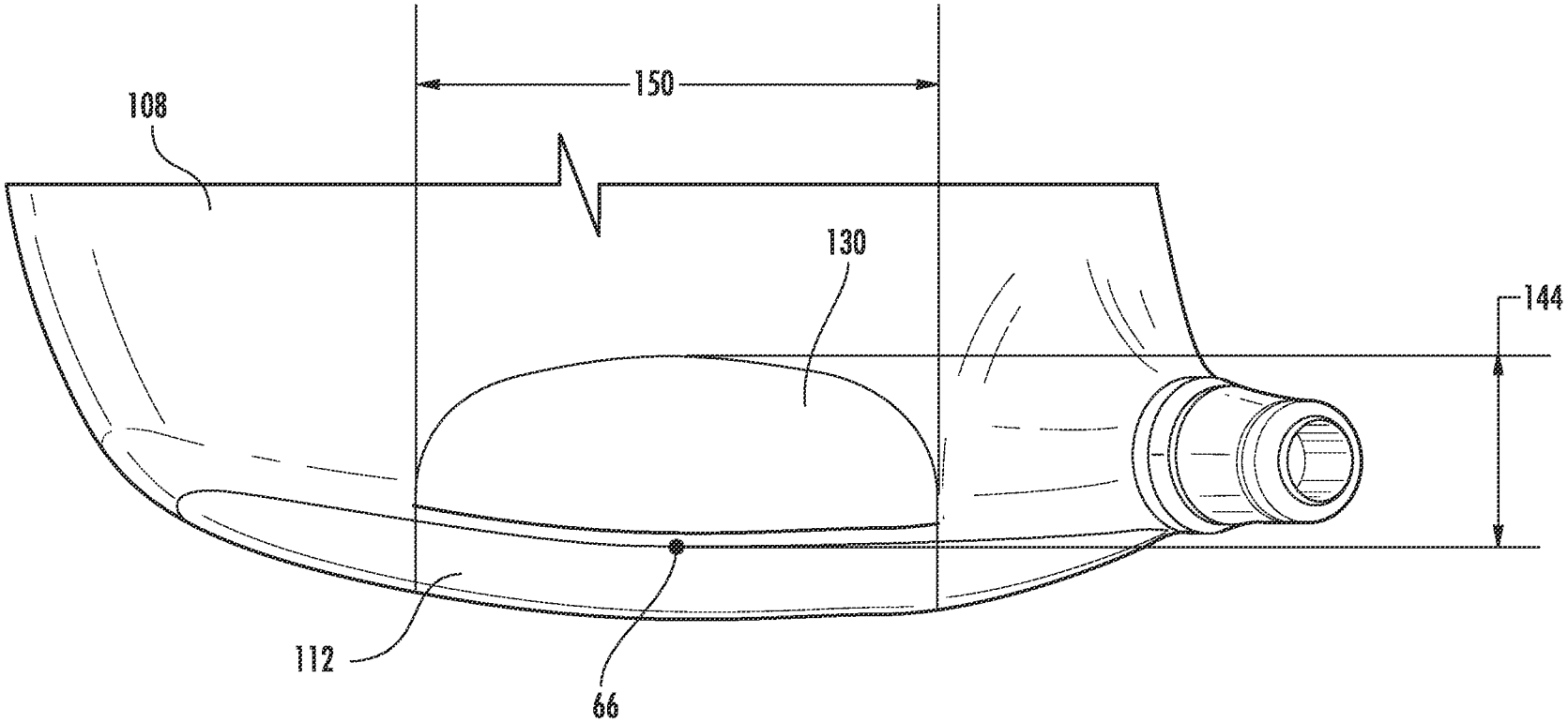
FIG. 13 is a magnified view of an alternate embodiment of a portion of the club head of FIG. 5.

FIG. 13 shows another alternate embodiment of head 102 where the face member 112 as described above may be made of a first material comprising the ball striking surface 111 and a flange 130 that may be made of a second material, where the flange 130 comprises a portion of the crown 116. Similar to the embodiments previously discussed, the second material may have a lower modulus of elasticity than the first material and the material of the remaining club head body.

Figure 14:
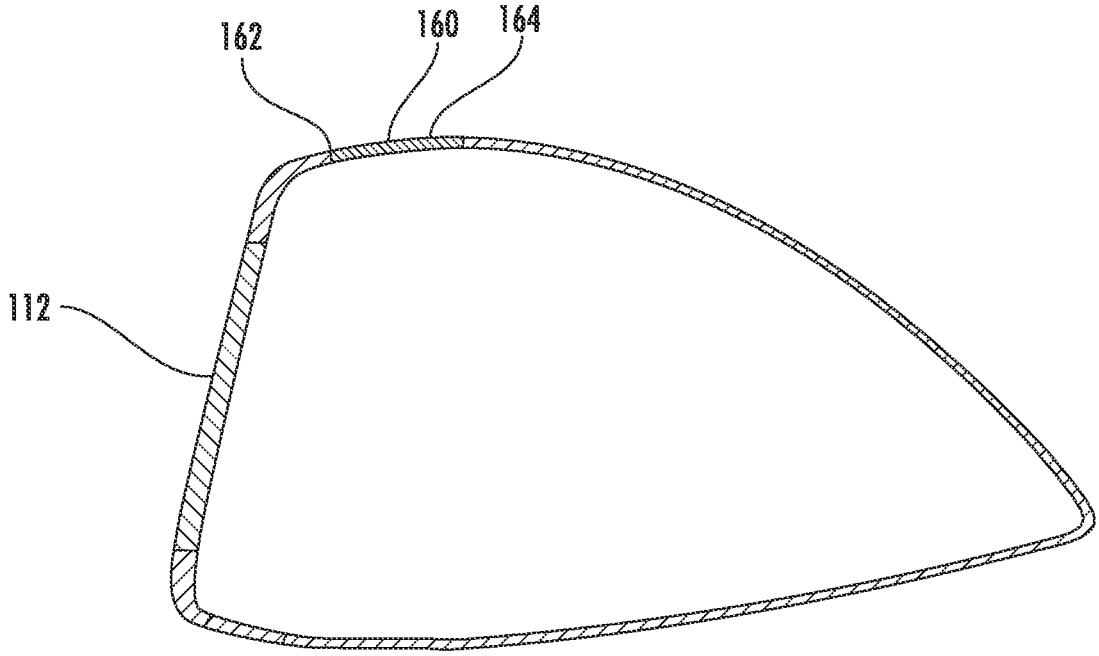
FIG. 14 is cross-section view taken of an alternate embodiment of the club head along line 8-8 of FIG. 6.

FIG. 14 shows an additional alternate embodiment where golf club head 102 may be a face-pull construction where the face member 112 comprises a portion of the ball striking surface 114. The club head body 108 may comprise a plurality of materials where a toe, a heel, a sole, and a portion of a crown may be made of a first material and a region 160 comprising a portion of the crown proximate the striking face may be made of a second material. The second material may be a material with a lower modulus of elasticity than the first material of the surrounding club head body 108 or the material of the face member such as a beta titanium alloy, gum Metal™, aluminum, polymer, vitreous alloys, metallic glasses or other amorphous metallic materials, composite materials (carbon fiber and others), or other suitable material. The region 160 may be formed having a similar shape, length, width, thickness, and location similar to the second member 134 in the embodiments shown in FIGS. 1-13.

Figure 15:
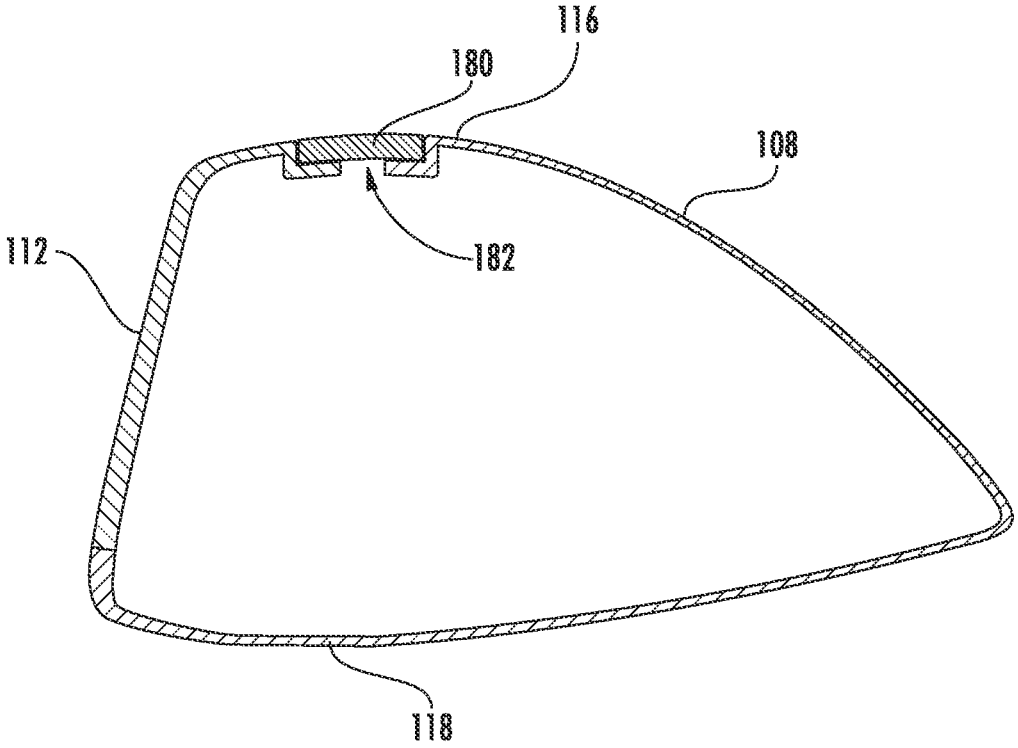
FIG. 15 is cross-section view taken of an alternate embodiment of the club head along line 8-8 of FIG. 6.

FIG. 15 shows yet another embodiment of the golf club head 102 where a region 180 may be connected to a face member 112 comprising of a portion of a ball striking surface 111 and a portion of the crown surface 116 and the club head body 108. The region 180 may be integrally joined between the face member 112 and the club head body 108 spanning an opening 182 created when the face member 112 and club head body 108 are integrally joined. In this embodiment, the club head body 108 may be made of a first material and the face member 112 may be made of a second material, while the region 180 may be made of a third material. Similar to the previously described embodiments, the third material may have a lower modulus of elasticity than either the first material or the second material. The third material may be a beta titanium alloy, gum Metal™, aluminum, polymer, vitreous alloys, metallic glasses or other amorphous metallic materials, composite materials (carbon fiber and others), or other suitable material. The region 180 may be formed having a similar shape, length, width, thickness, and location similar to the second member 134 in the embodiments shown in FIGS. 1-13.

Figure 16:
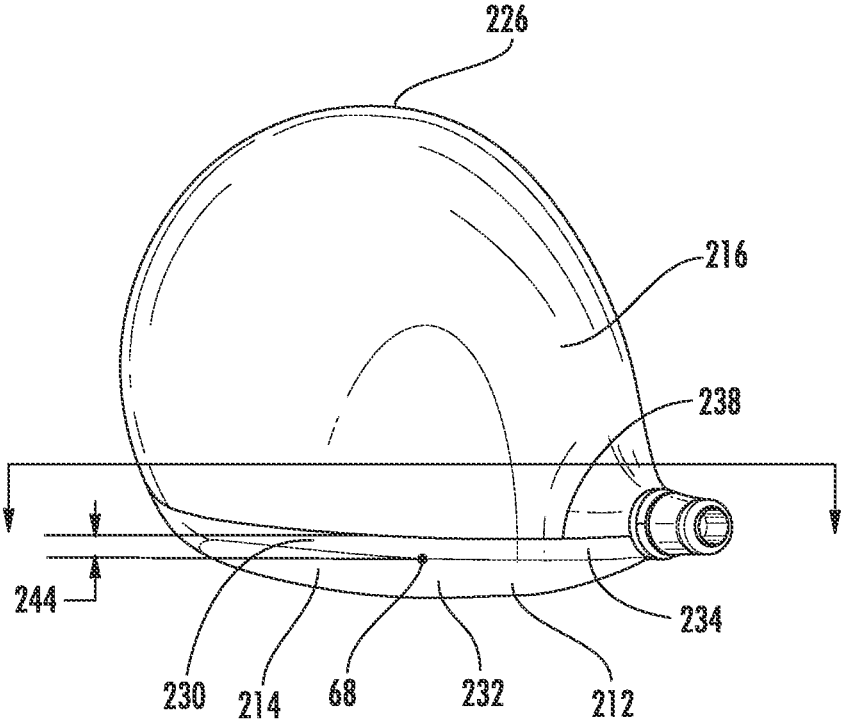
FIG. 16 is a top view of an alternate embodiment of the club head.
Figure 17:
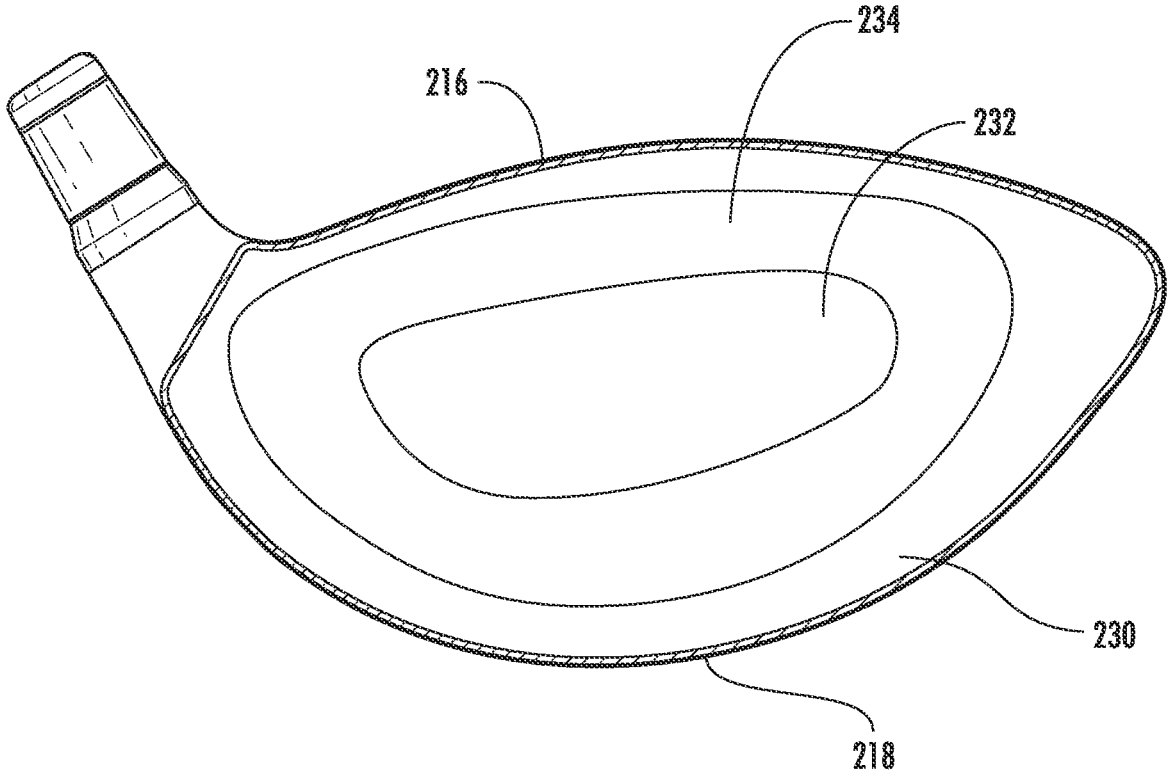
FIG. 17 is a cross-section view taken of an alternate embodiment of the club head along line 17-17 of FIG. 16.

For embodiment of FIGS. 16-17, the features are referred to using similar reference numerals under the "2xx" series of reference numerals, rather than "1xx" as used in the embodiment of FIGS. 1-15. Accordingly, certain features of the head 202 that were already described above with respect to head 102 of FIGS. 1-15 may be described in lesser detail, or may not be described at all. FIGS. 16-17 show another embodiment of head 202 where the face member 212 may comprise a plurality of materials where a first member 232 made of a first material comprises a portion of the striking surface and a second member 234 made of a second material comprises a portion of the striking face 214 and at least a portion of the crown 216. The second material may have a lower modulus of elasticity than the first material. The first material may be a titanium alloy such as Kobe Steel KS120, Ti-6V-4Al, Ti-8Al-1Mo-1V, or a Kobe Steel Ti-15-0-3. The second member 234 may form a flange 230 of a cup face that comprises at least a portion of the crown 216 and a portion of the sole 218. The second material may be a beta titanium alloy, gum Metal™, a vitreous alloy, metallic glass or other amorphous metallic material. By having a second member made of a material with a lower modulus of elasticity, the COR of the club head can be increased. Alternatively, the first member 232 may be the same material as the second member 234 where the face member 212 is made of a single material that has a lower modulus of elasticity compared to the club head body 208. For example, the face member 212 may be made of a beta titanium alloy, gum Metal™, vitreous alloy, metallic glass or other amorphous metallic material. By creating a portion of the ball striking face 214 with a material with a lower modulus of elasticity, the overall COR may increase up to as much as 0.880.

The flange 230 may have a thickness of approximately 1.5 mm, or within a range of 1.0 mm to 2.0 mm, or within a range of 0.7 mm to 2.5 mm. The striking face portion 214 of the second member 234 may have a thickness of approximately 2.0 mm, or within a range of 1.7 mm to 2.3 mm, or within a range of 1.5 mm to 2.7 mm.

The flange 230 may be positioned where the rear edge 238 of the flange 230 is located a distance 244 in the Y-Axis direction from the crown-face intersection point 68. The distance 244 may be approximately 15 mm, or in a range of 10 mm to 20 mm, or in a range of 7 mm to 25 mm.

For all of the embodiments disclosed herein, the width of the second member 134, 160, 180 when measured from the front to the back of head 102 may be expressed as a ratio of the breadth dimension 60 of head 102. For example, the ratio of the center width 147 dimension (expressed as dimension 147 in FIG. 10) to the breadth 60 of the golf club head 60 may be approximately 1:15 for a driver or within a range between 1:8 and 1:26. Likewise, for a smaller golf club head like a fairway wood, this ratio of center width 147 to overall breadth of the golf club head may be approximately 1:10 or within a range between 1:7 and 1:17. For an even smaller golf club head like a hybrid, this ratio of center width 147 to overall breadth of the golf club head may be approximately 1:7 or within a range between 1:5 and 1:13.

Likewise, the size of the second member 134 when measured from the front to the back of the head 102 may be expressed as a ratio of the face height dimension 56 of the head 102. For example, the ratio of the center width dimension (expressed as dimension 147 in FIG. 10) the ratio of the center width 147 to the face height dimension 56 may be approximately 1:7 for a driver or within a range between 1:4 and 1:12. Likewise, for a smaller golf club head like a fairway wood or hybrid, this ratio of center width 147 to overall face height of the golf club head may be approximately 1:4 or within a range between 1:2 and 1:8.

It is understood that one or more different features of any of the embodiments described herein can be combined with one or more different features of a different embodiment described herein, in any desired combination. It is also understood that further benefits may be recognized as a result of such combinations. Golf club heads 102 may contain any number of sole features such as channels or lower modulus regions in combination with the features of the embodiments disclosed herein.

Golf club heads 102 incorporating the body structures disclosed herein may be used as a ball striking device or a part thereof. For example, a golf club 100 as shown in FIG. 1 may be manufactured by attaching a shaft or handle 104 to a head that is provided, such as the heads 102, et seq., as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102 as described above may be provided. For example, a set of golf clubs may include one or more drivers, one or more fairway wood clubs, and/or one or more hybrid clubs having features as described herein. In other embodiments, different types of ball striking devices can be manufactured according to the principles described herein. Additionally, the head 102, golf club 100, or other ball striking device may be fitted or customized for a person, such as by attaching a shaft 104 thereto having a particular length, flexibility, etc., or by adjusting or interchanging an already attached shaft 104 as described above.

The ball striking devices and heads therefore having the face member 112 as described herein provide many benefits and advantages over existing products. For example, the flexing of the second member 134 results in less deformation of the golf ball, which in turn can result in greater impact efficiency and increased ball speed after impact. As another example, the more gradual impact created by the flexing can result in greater energy and velocity transfer to the ball during impact. Still further, because the second member 134 may become larger toward the heel and toe edges 128 of the ball striking surface 114, the head 102 can achieve increased ball speed on impacts that are away from the center or traditional "sweet spot" of the ball striking surface 114. The greater flexibility of the second member 134 near the heel 120 and toe 122 achieves a more flexible impact response at those areas, which offsets the reduced flexibility due to decreased face height at those areas, further improving ball speed at impacts that are away from the center of the ball striking surface 114. Further benefits and advantages are recognized by those skilled in the art.

The benefits of the face member 112 with the lower modulus second member 134 and other body structures described herein can be combined together to achieve additional performance enhancement. Additionally, the features disclosed herein may be combined with other body structures in other regions of a golf club head, such as an elongated channel on the sole, to improve performance. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. A golf club head comprising:

a club head body member formed of a first material comprising a heel, a toe, a portion of a crown, and a sole;

a face member comprising a ball striking surface formed of a second material and a flange; wherein the flange is coupled and extends from the ball striking surface to form a portion of the crown and wherein the flange further comprises a third material contained within the flange;

wherein the club head body member and the face member are coupled to each other;

wherein the third material of the flange is contained within the crown;

wherein the third material has a modulus of elasticity that is different from either the first material or the second material;

wherein a width of the third material measured in a front-to-back direction varies in width such that the width of the third material varies in a direction from a center of the flange towards the heel and toe;

wherein the flange further comprises an opening extending through the flange; and wherein the third material of the flange spans the opening.

2. The golf club head of claim 1, wherein the third material is gum metal.

3. The golf club head of claim 1, wherein a rear edge of the flange is within a range of 5 mm and 40 mm from a crown-face intersection point.

4. The golf club head of claim 1, wherein the flange extends into another portion of the club head body member selected from the group consisting of the heel, the toe, and the sole.

5. The golf club head of claim 1, wherein the flange has a thickness that varies within a range of 0.8 mm to 2.2 mm.

6. The golf club head of claim 1, wherein the flange has a constant thickness in a range of 0.8 mm to 2.2 mm.

7. A golf club head comprising:

a club head body member formed of a first material comprising a heel, a toe, a portion of a crown, and a sole;

a face member comprising a ball striking surface formed of a second material and a flange; wherein the flange is coupled and extends from the ball striking surface to form a portion of the crown and wherein the flange further comprises a third material contained within the flange;

wherein the club head body member and the face member are coupled to each other;

wherein the third material of the flange is contained within the crown;

wherein the third material has a density that is different from either the first material or the second material;

wherein a width of the third material measured in a front-to-back direction varies in width such that the width of the third material varies in a direction from a center of the flange towards the heel and toe;

wherein the flange further comprises an opening extending through the flange; and wherein the third material of the flange spans the opening.

8. The golf club head of claim 7, wherein the second material of the ball striking surface is formed from a composite or carbon fiber reinforced polymer material.

9. The golf club head of claim 8, wherein a rear edge of the flange is within a range of 5 mm and 40 mm from a crown-face intersection point.

10. The golf club head of claim 7, wherein the third material has a modulus of elasticity that is at least 10 percent lower than a modulus of elasticity of the second material.

11. The golf club head of claim 7, wherein the flange extends into another portion of the club head body member selected from the group consisting of the heel, the toe, and the sole.

12. The golf club head of claim 7, wherein the flange has a thickness that varies within a range of 0.8 mm to 2.2 mm.

13. The golf club head of claim 7, wherein the flange has a constant thickness in a range of 0.8 mm to 2.2 mm.

14. The golf club head of claim 7, wherein the face member forms at least 70% of a surface area of the ball striking surface.

15. A golf club head comprising:

a club head body member formed of a first material comprising a heel, a toe, a portion of a crown, and a sole;

a face member comprising a ball striking surface formed of a second material and a flange; wherein the flange is coupled and extends from the ball striking surface to form a portion of the crown and wherein the flange further comprises a third material contained within the flange;

wherein the club head body member and the face member are coupled to each other;

wherein the third material of the flange is contained within the crown;

wherein the third material has a material property that is different from either the first material or the second material;

wherein a width of the third material measured in a front-to-back direction varies in width;

wherein the flange further comprises an opening extending through the flange; and wherein the third material of the flange spans the opening.

16. The golf club head of claim 15, wherein the third material is gum metal.

17. The golf club head of claim 15, wherein the flange extends into another portion of the club head body member selected from the group consisting of the heel, the toe, and the sole.

18. The golf club head of claim 15, wherein the second material of the ball striking surface is formed from a composite or carbon fiber reinforced polymer material.

19. The golf club head of claim 15, wherein the face member forms at least 70% of a surface area of the ball striking surface.

20. The golf club head of claim 15, wherein a rear edge of the flange is within a range of 5 mm and 40 mm from a crown-face intersection point.

* * * * *